United States Patent [19]

Williams et al.

[11] Patent Number: 5,067,584

[45] Date of Patent: Nov. 26, 1991

[54] LOW COST REPLACEABLE TYPE SOUND DAMPENING UNIT FOR VACUUM CLEANING MACHINE

[76] Inventors: William H. Williams, 4938 Golden Arrow Dr., Rancho Palos Verdes, Calif. 90274; Paul G. Jacobs, 9958 Amestoy Ave., Northridge, Calif. 91325

[21] Appl. No.: 514,521

[22] Filed: Apr. 25, 1990

[51] Int. Cl.[5] ..... F01N 3/02; F01N 3/06

[52] U.S. Cl. ..... 181/231; 181/282

[58] Field of Search ..... 181/224, 240, 230, 231, 181/243, 258, 269, 282

[56] References Cited

U.S. PATENT DOCUMENTS

| | | | |
|---|---|---|---|
| 2,152,205 | 3/1939 | Morrison | 181/230 |
| 3,308,608 | 3/1967 | Brimberg | 181/230 X |
| 3,882,961 | 5/1975 | Cannan et al. | 181/258 |
| 4,015,683 | 4/1977 | Williams | 181/231 |
| 4,475,264 | 10/1984 | Schulz | 181/238 X |
| 4,665,581 | 5/1987 | Oberdorfer | 181/231 X |

FOREIGN PATENT DOCUMENTS

| | | | |
|---|---|---|---|
| 329237 | 5/1930 | United Kingdom | 181/130 |

*Primary Examiner*—Brian W. Brown

*Attorney, Agent, or Firm*—Joseph E. Mueth

[57] ABSTRACT

A physical shape-conformable, disposable, self-sustaining sound dampening unit adapted to attach to the air exhaust of a pair of electric motors to dampen the noise produced by the same, which comprises:

a body member formed of a thin imperforate film outer layer and a polymer foam inner layer lining the interior of said body member and having two inlet ports and at least one outlet port, the body having an interior pathway between the inlet ports and the outlet port, said inlet and outlet ports being disposed so that the incoming airstream impinges on an interior closed foam covered wall of said body and is made to turn at a right angle before reaching said outlet port.

7 Claims, 3 Drawing Sheets

LOW COST REPLACEABLE TYPE SOUND DAMPENING UNIT FOR VACUUM CLEANING MACHINE

BACKGROUND OF THE INVENTION

In the prior art, various devices have been proposed for the reduction of sound emitted by vacuum cleaner motors.

In Williams, U.S. Pat No. 4,015,683, there is disclosed a noise suppressor package to be attached to the air exhaust tubing of a vacuum cleaner, comprising an annular body which defines an axially extending bore to pass the exhaust. The body includes compressible foam segments which project radially inwardly at the bore to present a grooved inner surface, with the segments being axially elongated and circularly spaced. A tubular cover extends about the body and has a flexible neck at one end of the body. The neck is radially constricted about the exhaust tubing to retain the package to the tubing. The air exhaust passage runs directly through the noise suppressor package.

Oberdorfer, U.S. Pat. No. 4,665,581 pertains to a vacuum cleaner apparatus which has separate passages for the outgoing air from the blower and for cooling air for the blower motor, and has a number of turns in each of the passages. The turns develop increased air friction and back pressure. The passages have a plurality of variations in their cross-sectional area, and are provided with sound-absorbent linings which also create air friction and back pressure. The Oberdorfer apparatus appears to be of expensive construction and not disposable. The bending of high velocity air flow around a hard baffle-like surface creates noise and the hard surfaces are undesirable because they possess poor dampening characteristics with respect to low frequency sound.

A patent to Schulz, U.S. Pat. No. 4,475,264, discloses a dual inlet muffler assembly for a truck hot water vacuum extraction machine which has an elongated hollow plastic body which mounts a first exhaust pipe of L-shaped configuration passing completely through the body. Its inlet end is connected to the positive air pressure discharge of one vacuum pump connected to a closed dirty water vacuum dump tank for the hot water vacuum extraction machine. A second L-shaped exhaust pipe is reversely oriented within the hollow body and has a plugged end abutting the side of the first pipe near its inlet to the body. Both pipes are perforated within portions internal of the body and the hollow body is filled with glass wool to muffle the sound. The second pipe, at its inlet end, is connected to the positive pressure air discharging from a second vacuum pump also connected to the vacuum dump tank. The exhaust from the vacuum pumps is muffled with the air discharging through the perforations upstream of the plugged end of the second pipe passing through the glass wool, entering the perforations in the first pipe, and mixing commonly with the exhaust air flow carried by the first pipe. The disadvantages of Schultz include substantial back pressure, water build up in glass wool due to high humidity air flow, expensive construction, and the device is not of a low cost replaceable type.

The Brimberg U.S. Pat. No. 3,308,608 discloses providing an improved vacuum cleaner in which the housing is of light-weight construction so as to contribute to the portability thereof, and wherein the housing is said to have vibration-damping and soundproofing or sound absorbing characteristics in the form of a body of foamed, semi-rigid plastic, such as foamed polystyrene or polyurethane. The housing has compartments therein for accommodating the motor-fan unit and the dust collector or separator, with the outer surface of the foamed plastic body being covered by a layer of elastomeric material to resist damage to the foamed plastic body when the latter is subjected to impacts, as well as to avoid scratching or marring of furniture, walls or the like with which the housing is inadvertently contacted. The disadvantages of Brimberg are: not suitable for wet use—will retain moisture/water; flow baffles and restrictors will create back pressure; expensive construction; and not of a removable low cost disposable type.

Canaan et al., U.S. Pat. No. 3,882,961 pertains to an air-filtering, sound-attenuating muffler. The muffler includes an attenuator box and a multi-layer muffler filler. The layers of the muffler filler are reticulated polyurethane foam of varying pore densities. Air is directed through the muffler from the least dense to the most dense layer. The disadvantages of Canaan et al. include extensive back pressure problems—air flow forced through sound dampening media, the devise is not constructed for wet application, and is not of a replaceable los cost disposable type.

With the exception of Williams U.S. Pat. No. 4,015,683, the prior art units described in this application are of expensive permanent construction and all will develop, to various degrees, detrimental back pressure and thus affect the basic function and performance of any vacuum motor.

SUMMARY OF THE INVENTION

Briefly, the present invention comprises a physical shape conformable, self-sustaining disposable sound dampening unit adapted to attach to the air exhaust port of single or multiple electric vacuum motors to dampen the noise produced by the same, which comprises:

a body member formed of a thin imperforate film outer layer and a polymer foam inner layer lining the interior of said body member and having single or multiple inlet ports and at least one outlet port, the body having an interior pathway between the inlet ports and the outlet port, said inlet and outlet ports being disposed so that the incoming airstream impinges on an interior acoustic foam covered wall of said body and is made to turn at a right angle to create an air flow scattering effect before reaching said outlet port.

The muffler interior area size and outlet port exceeds the vacuum motor exhaust port (inlet port), thereby eliminating the possibility of muffler back pressure.

It is an object of our invention to provide a novel sound dampening unit uniquely adapted to muffle the noises emitted by the electric vacuum motors used in vacuum cleaning devices.

It is an object of our invention to provide a novel muffler in which the air stream impinges on the sound dampening material.

It is also an object of this invention to provide a muffler which is inflatable to conform to the available space inside the housing of a vacuum cleaner.

A further object of this invention is to provide a muffler of composite construction to present one flexible layer which dampens low frequencies and another which dampens high frequencies.

Yet another object of this invention is to provide a muffler where the muffler interior area and the muffler exhaust (outlet port) is substantially larger than the vacuum motor fan housing exhaust ports (muffler inlet ports), thereby slowing down the air flow exhaust velocity from the muffler and thus eliminating any possibility of air flow back pressure which is, detrimental to the basic operation and efficiency of any vacuum motor.

There and other objects and advantages of our invention will be apparent from the detailed description which follows.

DESCRIPTION OF PREFERRED EMBODIMENTS

Several important features of this invention will now be discussed.

The silencer or muffler of this invention involves the impingement of the airstream on the inside walls of the sound deadening unit. At the point of impingement, the effect is to produce a scattering effect in the airstream. Ultimately, it produces a 90° turn in the direction of flow of the airstream exhaust.

The unit itself is a composite structure having an outside film or jacket, normally a thin plastic vinyl, which is thermoplastic and which will soften when hot exhaust air passes through the muffler. This will result in a limp condition needed to efficiently absorb low frequency sound waves.

The inside walls of the unit are lined with an acoustic foam, such as a cellular rigid, semi-rigid or non-rigid polyurethane foam. This foam has been found to be uniquely capable of absorbing high frequency sound waves.

The composite muffler structure is conformable to the other rigid elements inside the case, body or shell of a vacuum cleaning device. For example, the inside walls of the case are usually a rigid molded plastic and within it are found the vacuum motors and other mechanical hardware. The muffler of this invention can simply expand under the air pressure of the exhaust to inflate to the optimum aerodynamic configuration for the airflow and adapt to the available space. Unlike the prior art, the muffler of this invention is not confined to a single or fixed shape or configuration. Rather, the shape of the unit can vary with the operating conditions and the shape and location of adjoining nonyielding structures.

The muffler unit of this invention is easy to fabricate, for example, from flat foam stock, and does not require or involve any complicated grooves in foam, such as is found in the prior art.

An important feature of the invention is that the interior area and the muffler exhaust opening is substantially larger than the vacuum motor fan housing exhaust port, thereby slowing down the air flow exhaust velocity from the muffler, and thus eliminating any possibility of air flow back pressure, detrimental to any vacuum motor basic operations and efficiency. In spite of the absence of back pressure, the unit is surprisingly effective in deadening sound over a wide range of high and low frequencies. The fact that the muffler of the present invention has a lower velocity air discharge is very significant in vacuum cleaners, since there is less stirring up of dust.

Turning to the drawings.

Figure 1:
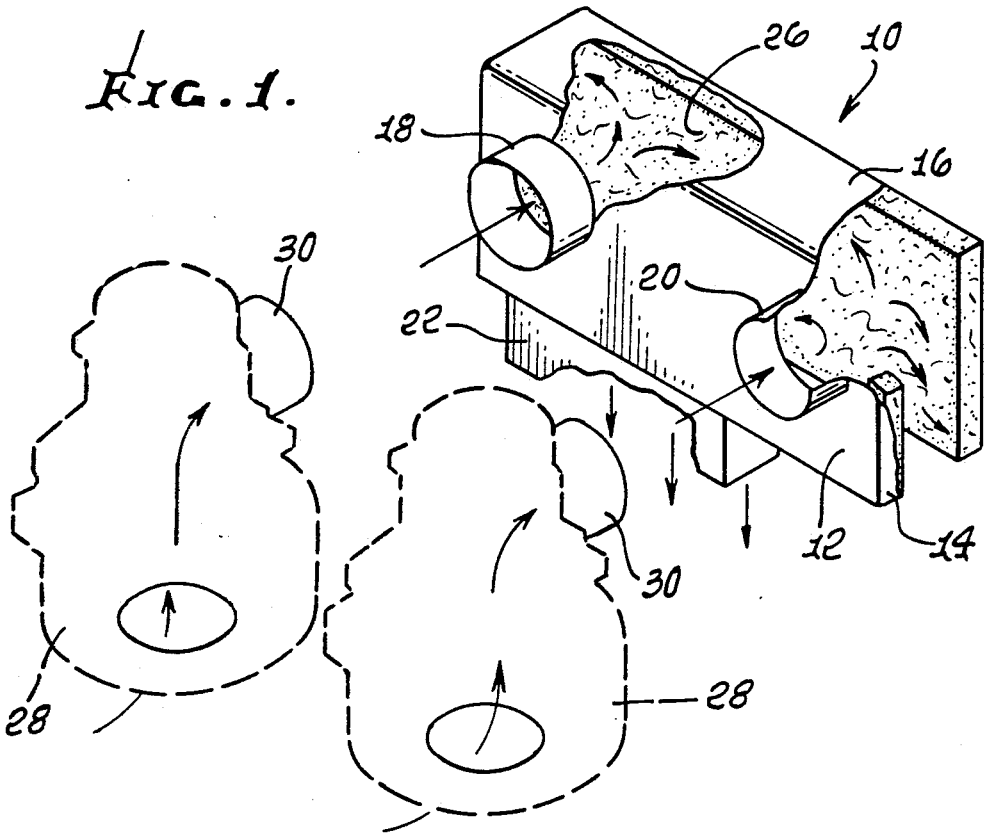
FIG. 1 is a perspective view of the unit of the present invention showing a dual motor application, and the partial breakaway illustrates the scatter pattern within the muffler during use.
Figure 2:
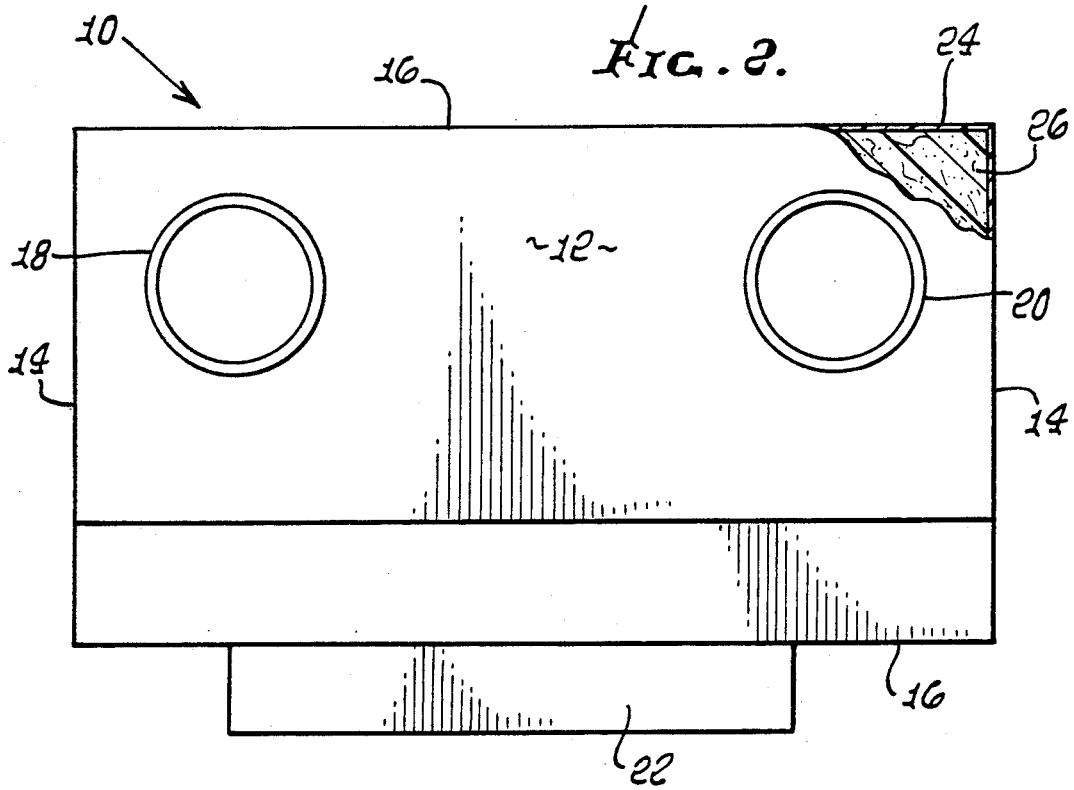
FIG. 2 is a front view of the unit of FIG. 1.
Figure 3:
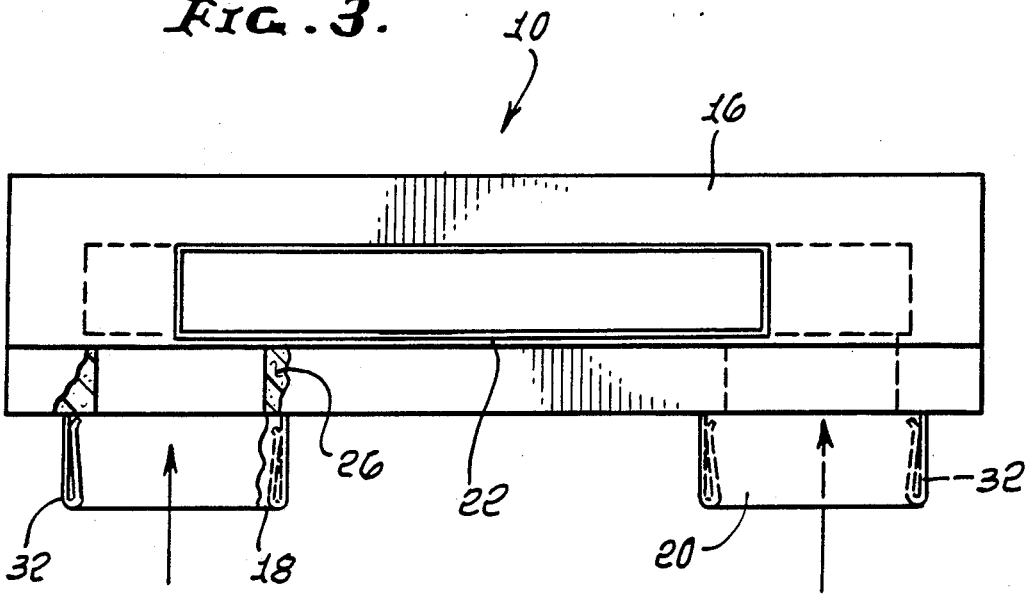
FIG. 3 is a bottom view of the unit depicted in FIG. 1.
Figure 4:
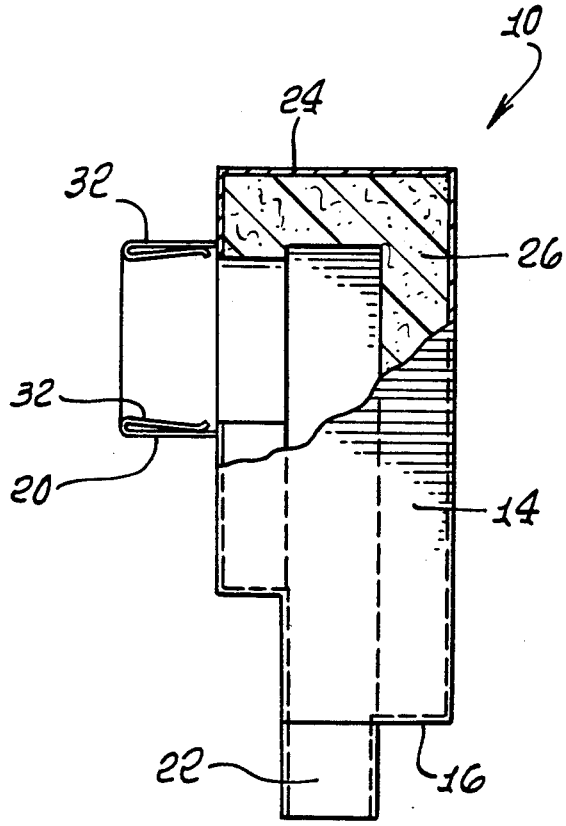
FIG. 4 is a side view, in partial breakaway, of the unit of FIG. 1.

Turning to the drawing in more detail, the muffler in one most preferred embodiment, prior to inflation, is an elongated box 10 having flat parallel sides 12, ends 14 and top and bottom 16.

The two electric vacuum motors adapted to be silenced or muffled by the novel muffler of this invention are shown in dotted lines in FIG. 1.

The two inlet ports 18 and 20 are spaced apart through side wall 12. The outlet port 22 passes through bottom wall 16.

The drawings indicate that the exterior surface 24 of the muffler is a thin, uniform, preferably thermoplastic polyvinylcholoride (PVC) film. The PVC film softens upon exposure to the moderately hot vacuum motor exhaust airstream passing through the muffler. The inside surface of the muffler is lined with a cellular semirigid polyurethane foam, or similar material 26, which absorbs the high frequencies and on which the airstream impinges.

The vacuum motors 28 each have exhaust ports 30 which are of essentially the same diameter and area as the inlet ports 20 of the muffler. The muffler may be held to the exhaust ports 30 by clips 32.

Figure 5:
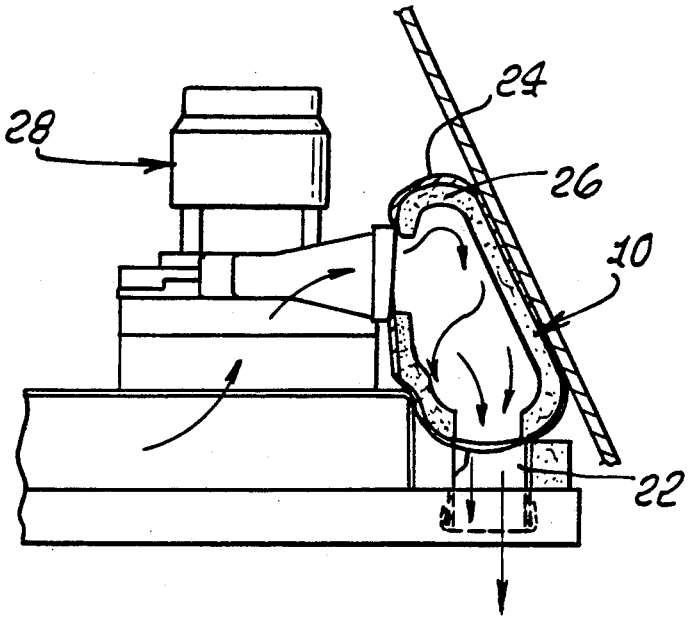
FIG. 5 is a side view, in partial breakaway, showing the muffler and vacuum cleaner of our invention in use.
Figure 6:
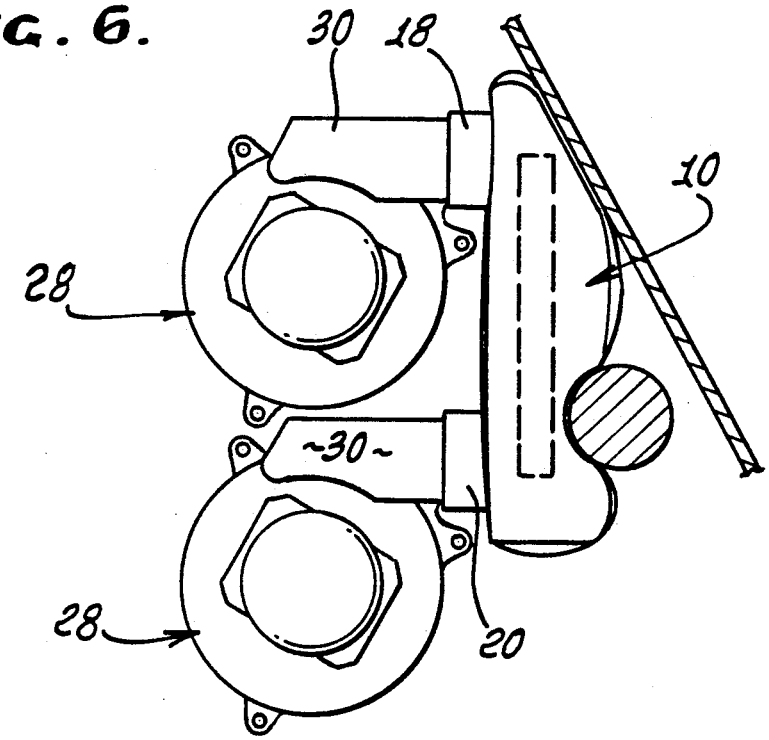
FIG. 6 is a top view of the apparatus of FIG. 5.

The muffler is set-sustaining and yet inflates slightly in use, and is conformable to surrounding objects, as shown in FIGS. 5 and 6. The ability to change shape in response to external restraining and adjoining nonyielding structures is an important attribute of the muffler.

The advantages of the invention include:

(a) self cleaning, wet and dry use;
(b) single or multiple vacuum motor application;
(c) low cost replaceable unit;
(d) easily removable;
(e) principal can be applied to vacuum motor cooling airflow as well as to the shown vacuum motor fan housing exhaust.

Having fully described the invention, it is intended that the invention be limited only by the scope of the appended claims.

We claim:

1. A physical shape-conformable, disposable, self-sustaining sound dampening unit for use on a noise-emitting vacuum motor having an air exhaust in the form of an airstream and adapted to attach to the air exhaust of said vacuum motor to dampen the noise produced by the vacuum motor, which comprises:

a body member formed of a thin imperforate film outer layer and a polymer acoustic foam inner layer lining interior surfaces of said body member, having an open inner cavity and at least one inlet port and at least one outlet port, the body having an unobstructed interior pathway between the inlet ports and the outlet port, said inlet and outlet ports being disposed so that an incoming airstream impinges on an interior acoustic foam covered wall of said body and is made to turn at a right angle to create an air flow scattering effect before reaching said outlet port, said body member being adapted to expand under pressure of said airstream to inflate and adapted to conform to external unyielding elements in contact with it.

2. A physical shape conformable, disposable, self-sustaining sound dampening unit for use on a noise-emitting vacuum motor having an air exhaust in the form of an airstream and adapted to attach to the air exhaust of a pair of electric motors to dampen the noise produced by the same, which comprises:

a body member formed of a thin imperforate film outer layer and a polymer acoustic foam inner layer lining the interior surfaces of said body member, having an open inner cavity and having two inlet ports and at least one outlet port, the body having an unobstructed interior pathway between the inlet ports and the outlet port, said inlet and outlet ports being disposed so that an incoming airstream impinges on an interior closed foam covered wall of said body and is made to turn at a right angle to create an air flow scattering effect before reaching said outlet port, said body member being adapted to expand under pressure of said airstream to inflate and adapted to conform to external unyielding elements in contact with it.

3. The sound dampening unit of claim 1 wherein the thin imperforate film is a thermoplastic vinyl absorptive of low frequency sound waves.

4. The sound dampening unit of claim 1 wherein the inner layer is a polyurethane foam absorptive of high frequency sound waves.

5. The sound dampening unit of claim 2 wherein the cross-sectional area of the two inlet ports is less than the cross-sectional area of the outlet port to reduce the outlet air velocity.

6. The sound dampening unit of claim 1 wherein the interior surfaces and the inner layer are flat.

7. In a vacuum cleaner having two noise-emitting vacuum motors for sucking up dirt into a collection zone contained within a case, said vacuum motors having an air exhaust in the form of an airstream, the improvement comprising in combination with the air exhaust of said vacuum motors a sound dampening unit for dampening the noise produced by the vacuum motors which comprises:

a body member formed of a thin imperforate film outer layer and a polymer acoustic foam inner layer lining interior surfaces of said body member, an open inner cavity and having two inlet ports and at least one outlet port, the body having an unobstructed interior pathway between the inlet ports and the outlet port, said inlet and outlet ports being disposed so that an incoming airstream impinges on an interior closed foam covered wall of said body and is made to turn at a right angle before reaching said outlet port, said body member being adapted to expand under pressure of said airstream to inflate and adapted to conform to external unyielding elements in contact with it.

* * * * *